US006953074B2

(12) United States Patent
Cardinal

(10) Patent No.: US 6,953,074 B2
(45) Date of Patent: Oct. 11, 2005

(54) ANTIBANDIT SHUTTER

(76) Inventor: Mike Cardinal, 28 Reid Street, Ardeer, Victoria (AU), 3022

( * ) Notice: Subject to any disclaimer, the term of this patent is extended or adjusted under 35 U.S.C. 154(b) by 0 days.

(21) Appl. No.: 10/399,276

(22) PCT Filed: Oct. 16, 2001

(86) PCT No.: PCT/AU01/01299

§ 371 (c)(1),
(2), (4) Date: Apr. 16, 2003

(87) PCT Pub. No.: WO02/33209

PCT Pub. Date: Apr. 25, 2002

(65) Prior Publication Data

US 2004/0011474 A1 Jan. 22, 2004

(30) Foreign Application Priority Data

Oct. 17, 2000 (AU) ..... PR 0828

(51) Int. Cl.[7] ..... E06B 9/30

(52) U.S. Cl. ..... 160/168.1 R; 160/172 R; 160/201

(58) Field of Search ..... 160/168.1 R, 172 R, 160/133, 33, 188, 201, 291, 310; 192/56.1, 71

(56) References Cited

U.S. PATENT DOCUMENTS

| | | | | | |
|---|---|---|---|---|---|
| 1,708,636 | A | * | 4/1929 | Shook | 160/150 |
| 1,744,387 | A | * | 1/1930 | Johanson | 160/102 |
| 2,135,647 | A | * | 11/1938 | Streby | 160/172 R |
| 2,197,445 | A | * | 4/1940 | Youker | 160/150 |
| 2,621,723 | A | * | 12/1952 | Etten | 160/34 |
| 2,760,566 | A | * | 8/1956 | Nicolas | 160/168.1 R |
| 2,957,520 | A | * | 10/1960 | Howard | 160/113 |
| 3,014,525 | A | * | 12/1961 | Zytka | 160/168.1 R |
| 3,034,574 | A | * | 5/1962 | Gerold | 160/34 |
| 3,578,060 | A | * | 5/1971 | Spencer | 160/172 R |
| 4,085,788 | A | * | 4/1978 | Bernardo | 160/133 |
| 5,045,873 | A | * | 9/1991 | Shinozaki et al. | 396/470 |
| 5,351,741 | A | * | 10/1994 | Swopes | 160/168.1 R |
| 5,566,738 | A | * | 10/1996 | Yadidya | 160/133 |
| 5,584,331 | A | * | 12/1996 | Lin | 160/172 R |
| 5,799,716 | A | * | 9/1998 | Yamaguchi et al. | 160/310 |
| 5,913,563 | A | * | 6/1999 | Watanabe et al. | 296/155 |
| 6,401,792 | B1 | * | 6/2002 | Mullet et al. | 160/188 |
| 6,412,539 | B1 | * | 7/2002 | Kuribayashi et al. | 160/310 |

FOREIGN PATENT DOCUMENTS

| | | | | | |
|---|---|---|---|---|---|
| CH | 664419 | A | * | 2/1988 | E06B/9/26 |
| EP | 0096664 | | * | 12/1983 | 160/172 R X |
| EP | 1331354 | | * | 7/2003 | 160/172 R X |
| FR | 2417414 | | * | 9/1979 | 160/172 R X |
| JP | 56-140698 | | | 3/1955 | |
| JP | 47-8427 | | | 3/1972 | |
| JP | 50-3948 | | | 2/1975 | |
| JP | 59-158693 | | | 10/1984 | |
| JP | 62-173483 | | | 11/1987 | |
| JP | 7-4776 | | | 1/1995 | |
| JP | 8-100582 | | | 4/1996 | |
| JP | 8-210049 | | | 8/1996 | |
| JP | 08246765 | A | * | 9/1996 | E06B/9/02 |
| JP | 8-260843 | | | 10/1996 | |
| JP | 08326445 | A | * | 12/1996 | E06B/9/02 |
| JP | 10-30386 | | * | 3/1998 | 160/172 R X |
| JP | 10-299363 | | | 11/1998 | |
| JP | 2001173341 | A | * | 6/2001 | E06B/9/302 |

* cited by examiner

*Primary Examiner*—Bruce A. Lev
(74) *Attorney, Agent, or Firm*—Dennison, Schultz, Dougherty & MacDonald

(57) ABSTRACT

An antibandit shutter includes a closed frame made up of a lower housing, an upper head and two side mullions defining a space which can be opened or closed. The opening or closing is effected by a plurality of elongate slats adapted to move from a retracted position within the confines of the lower housing to an expanded and raised position substantially closing off the space. The slats are guided along the mullions of the frame by a raising mechanism formed from a plurality of crossed first and second lever arms in the form of a lazy tongs mechanism, where the first lever arms are formed by the edges of the slats and the second lever arms are formed from slave levers.

19 Claims, 4 Drawing Sheets

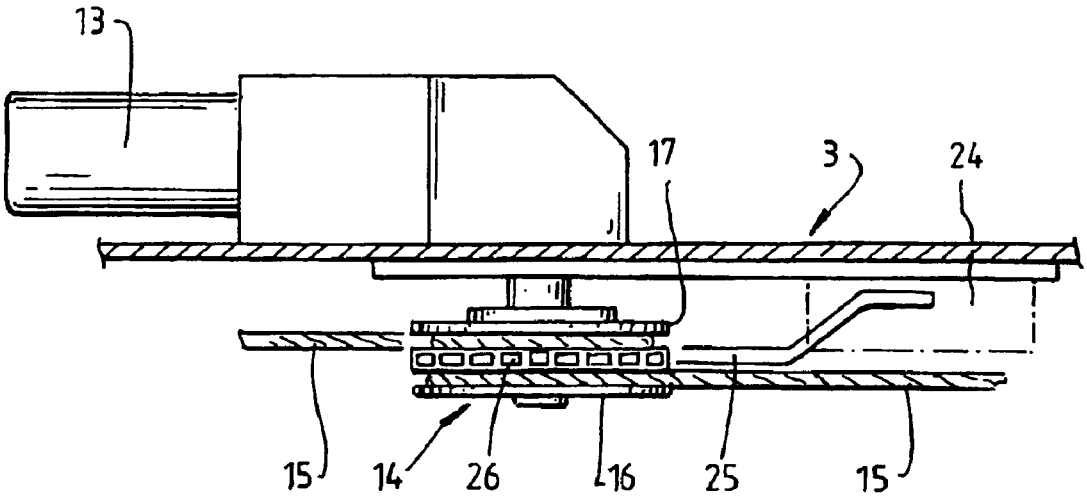
FIG. 5.
FIG. 7.
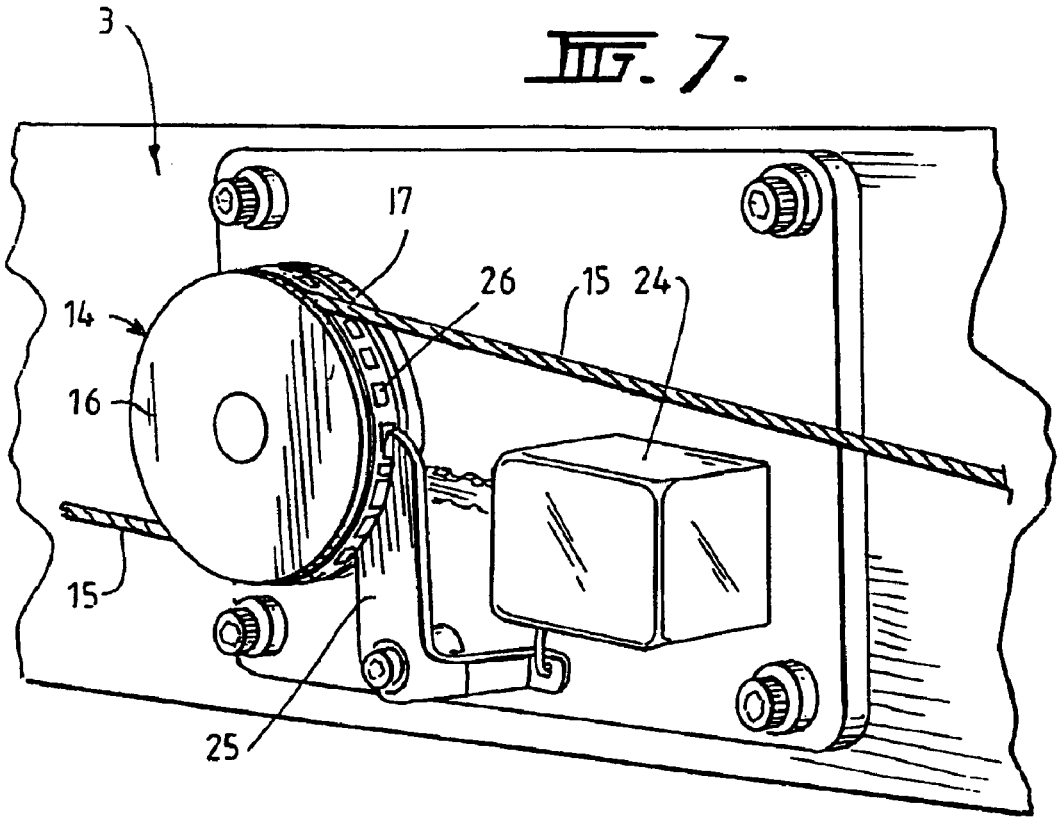

ANTIBANDIT SHUTTER

INTRODUCTION TO THE INVENTION

This invention relates to security shutters that are quickly activated and raised from an inconspicuous retracted position to a highly conspicuous position offering protection to user personnel from unwanted intrusion or aggression.

BACKGROUND TO THE INVENTION

Attacks and interference with personnel working in the public domain, in particular locations where money is exchanged and/or valuable goods are held in storage, are becoming increasingly frequent. Such personnel are often, by necessity, exposed to public contact in order to conduct necessary day to day business. In order to address such concerns a wide range of security products are available to reduce or minimise such risks. Such security products include alarm systems, surveillance cameras anti-jump barriers, static guards, fixed glazing and rising security screens. However, all the currently available security products suffer from various limitations or disadvantages.

For example, alarm systems, whilst offering a form of deterrence, are designed primarily as a call for assistance and will not necessarily actively deter an intruder or prevent an assault on personnel. Similarly, surveillance cameras record events and offer a limited amount of deterrence, but do not provide any physical barrier to physical violence. Anti-jump barriers provide a measure of protection, but cause interference in the day to day activities of personnel dealing with the public and are not yet socially acceptable aesthetically in many areas of the public domain. Static guards and fixed glazing panels provide a measure of deterrence, but are expensive to install, have a tendency to inhibit a friendly and free trading environment and restrict communication by putting a permanent barrier between the working personnel and the consuming public. Such difficulties are exacerbated when transfer of goods and monies between personnel and the public is involved. Rising screens are effective security devices and operate by providing an anti-ballistic steel screen between the working personnel and the consuming public. Such screens are highly expensive and dedicated pieces of equipment powered by highly sophisticated pneumatics and require dedicated installation in a working environment at considerable expense. Whilst such rising screens are highly effective and efficient, their cost and the high level of engineering required for operation, necessitating dedicated installation, renders them suitable only for very high risk environments including banks and credit unions where the high cost of installation can be justified including incorporation into counter refitting and overall design. Such systems are generally prohibitive for the average trader and in fact, generally only justifiable in situations where armed robbery or hold-ups involving guns and other forms of mortal threat to personnel are involved.

In general trading situations, other than the previously mentioned high-risk situations, a need exists for protection of personnel against physical attacks and threats including knife and syringe attacks and threats of physical violence by aggressive members of the public. In particular, an intermediate level of protection against such violence needs to be available in a cost effective and efficient manner without resorting to fitting of bullet proof security screens as part of a dedicated trading environment design. Such a security product would not necessarily have to be bullet proof, but should provide an immediately implemental interference between the operating personnel and an aggressive member of the public. Furthermore, such a protective system would preferably be adapted for retro-fitting to existing trading environments with minimal retro-fitting cost.

STATEMENT OF INVENTION

In one aspect the invention provides an antibandit shutter comprising a closed frame made up of a lower housing, an upper head and two side mullions defining a space which can be opened or closed wherein said opening or closing is effected by a plurality of elongate slats adapted to move from a retracted position within the confines of said lower housing to an expanded and raised position substantially closing off said space wherein said slats are guided along the mullions of said frame by a raising means comprising a plurality of crossed first and second lever arms in the form of a lazy tongs mechanism wherein said first lever arms are formed by the edges of said slats and said second lever arms are formed from slave levers.

The slats may move along tracks provided in said mullions and move consecutively or in coordination, by way of the raising means. The raising means may be adapted to move between a first concertinaed position within the confines of said lower housing and a second expanded position, drawing said slave levers and attached slats, progressively up said mullions to the upper head of the shutter.

The slave levers may be provided, on a first end thereof, with rollers adapted to cooperate with a slot formed in each mullion track such that the raising means will be drawn up and unfold vertically in line with the mullions, thereby drawing the slats up between the mullions so as to close off the space in the open frame.

The raising means may be operated by a motor positioned in the upper head and connected thereto by draw-wires positioned in the mullion slots. The guides, and attached slats, may be actively moved from the retracted to the raised position by action of the motor and passively returned to the retracted position by gravity.

The draw-wire may cooperate with the motor by way of a draw-pulley which spools the draw-wire as the motor is activated. The pulley may have a spacer and two flanges to provide a dual spool to accommodate a pair of said draw-wires operating in each mullion. The spools may be dimensioned to cause progressive spooling of the draw-wires, in a single layer, such that the initial activation of the motor provides a high torque/low speed spooling of the draw-wire which moves to a low torque/high speed spooling as the shutter reaches the fully expanded position. The draw-wire may be provided as a single wire passing throughout the centre of the pulley axle and extending either side to form the separate wires, or may be formed of two separate wires running on a common spool or running on separate dual spools. The draw-pulley may be provided with a locking ratchet around the periphery thereof which cooperates with an associated pawl for securely locking the draw-pulley against rotation when the pawl is engaged to the ratchet. The pawl may be activated electrically by a solenoid when required during appropriate stages of the activation of the shutter.

The shutter may incorporate various sensors for determining the position of the slats during activation. The sensors may include a first sensor positioned near the lower housing for determining when the slats are fully retracted. This sensor may be connected to the ratchet and pawl system such that when the slats are in their fully retracted position, either before activation or after the slats have been released for a gravity retraction, such that the slats can be locked in their retracted position thereby preventing rebound of the slats as they fall back into the lower housing. A second sensor may be positioned midway along the mullions so as to detect when the slats are toward or reaching the fully expanded position. This second sensor can cause the motor to begin slowing down so as to minimise the impact of the slats as they reach their fully expanded raised position and abut the upper head of the shutter. In order to further minimise the impact of the potentially violent closing of the shutter, a further cushioning means may be provided in the form of a resilient stopper. The resilient stopper may take the form of a band of rubber positioned at the lower end of the slats in the lower housing thereby remaining within the housing and protected from interference and damage. A third sensor may be provided at the upper end of the mullions near the upper head for determining when the slats reach the fully expanded state. The third sensor may then cause the ratchet of the draw-pulley to lock by the activation of a solenoid and engagement of the pawl with the ratchet thereby securely locking the slats and preventing forceful incursion or other interference with the closed shutter.

The invention will now be described with reference to one particularly preferred embodiment as shown in FIGS. 1 to 6.

FIG. 5 shows a plan view of the operating motor.

FIG. 7 shows the draw-pulley and ratchet.

| LEGEND | |
|---|---|
| 1 | Lower housing |
| 2 | Side mullions |
| 3 | Upper head |
| 4 | Slats |
| 5 | Vertical tracks |
| 6 | Lazy tong guides |
| 7 | Slave lever arms |
| 8 | First ends |
| 9 | Second ends |
| 10 | Central pivot |
| 11 | Captive guide rollers |
| 12 | Elongate level slot |
| 13 | Motor |
| 14 | Draw-pulley |
| 15 | Draw-wires |
| 16 | First flange |
| 17 | Second flange |
| 18 | Receiving channels |
| 19 | Holding pin |
| 21 | First sensor |
| 22 | Second sensor |
| 23 | Third sensor |
| 24 | Solenoid |
| 25 | Pawl |
| 26 | Ratchet |
| 27 | Planar face |
| 28 | Intermediate channel |
| 29 | Stopped edge |
| 30 | Adjustment pulleys |

-continued

| LEGEND | |
|---|---|
| 31 | Shuttle |
| 32 | Restraining Band |
| 33 | Top Cover |
| 34 | Protective Skirt |
| 35 | Lower Housing Opening |

DETAILED DESCRIPTION OF THE INVENTION

Figure 1:
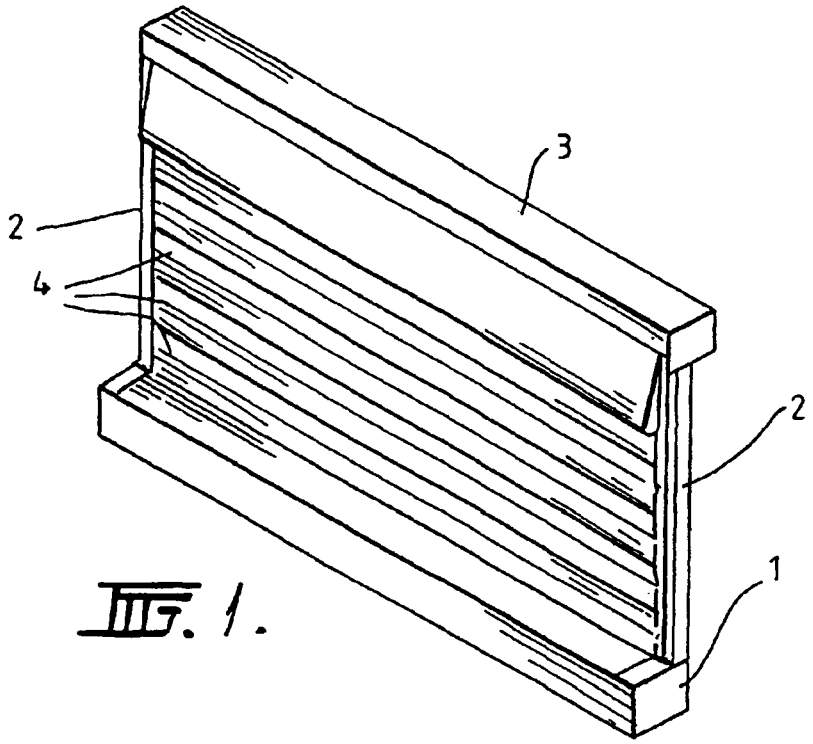
FIG. 1 shows a perspective view of the invention with the shutter fully closed.

Referring firstly to FIG. 1 the invention provides an anti bandit shutter in the form of a modular unit which is adapted for ready retro-fitting to a variety of counter and other public interface facilities. The shutter is made up in the form of a closed frame having a lower housing 1 in the form of a shallow box with two side mullions 2 rising from either side of the lower housing and finishing in an upper head 3.

The assembly of the housing upper head and two vertical mullions provide the closed frame which serves to define a finite space on a counter or other public interface situation which can be either open for free access to the public or rapidly and readily closed off so as to protect the operator from any undesirable situations that might arise on the other side of the security shutter. The closed frame of the invention is provided with a plurality of elongate slats 4 which, in one particular embodiment of the invention, are orientated horizontally and are adapted to move between a first retracted position, with all the slats confined to the housing 1, and an expanded position (as shown in FIG. 1) where the assembly of slats serves to fully close off the said space.

Figure 2:
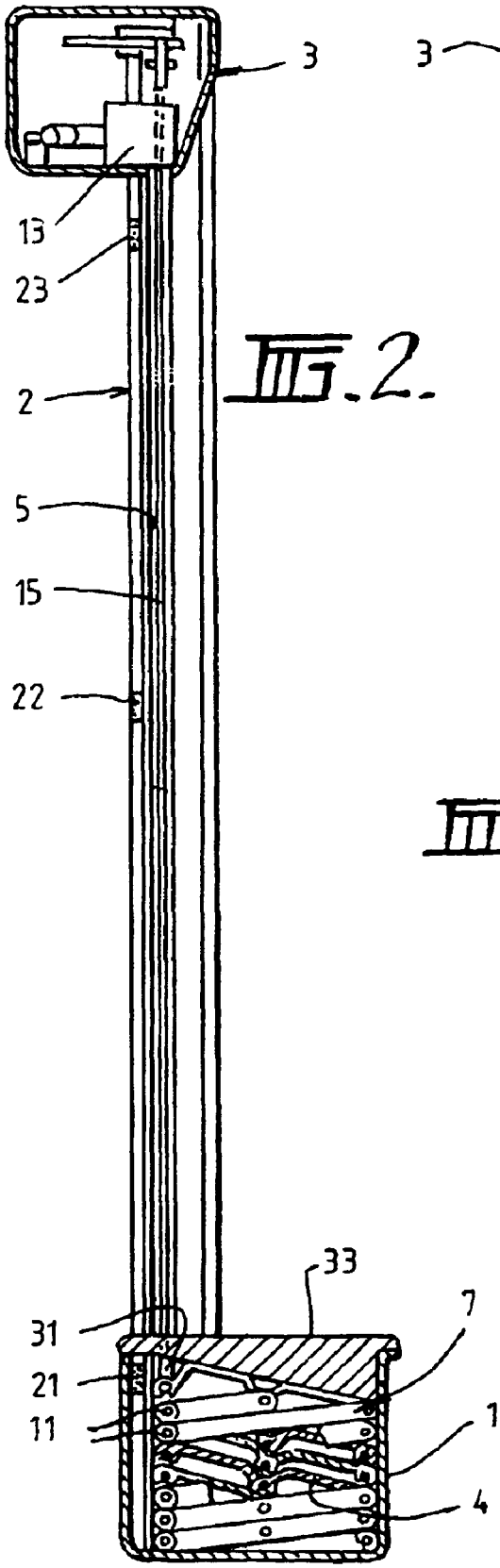
FIG. 2 shows a cut away side view of the invention with the shutter fully open.
Figure 3:
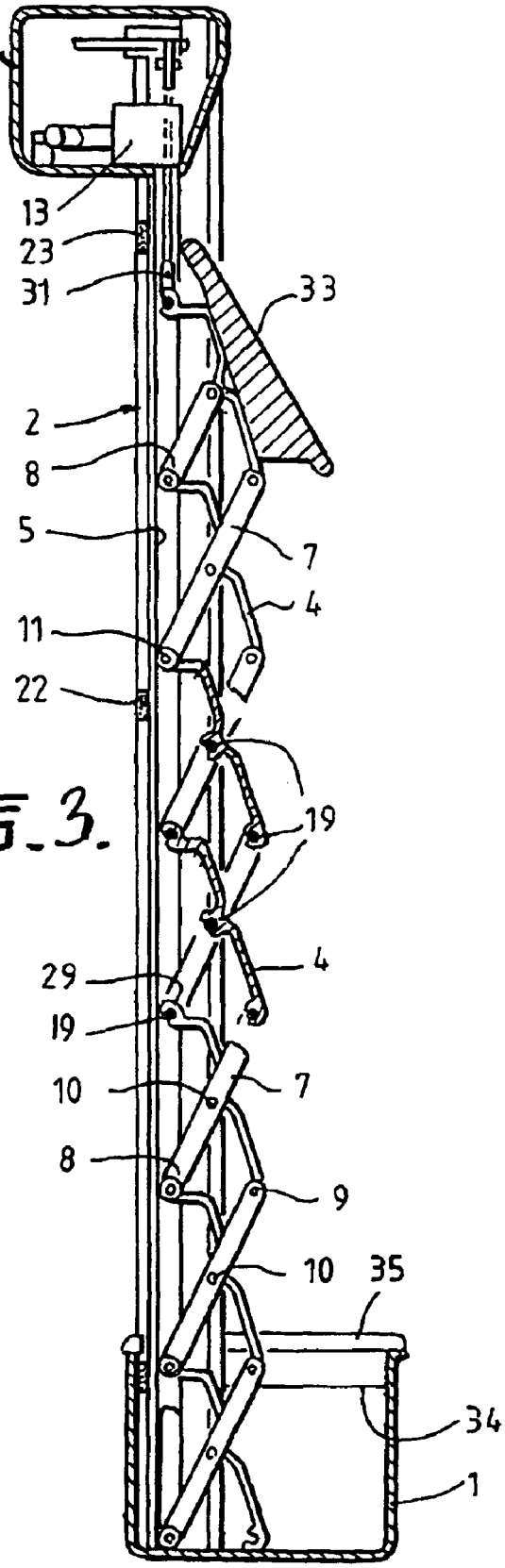
FIG. 3 shows a cut away side view with the shutter partially closed.
Figure 4:
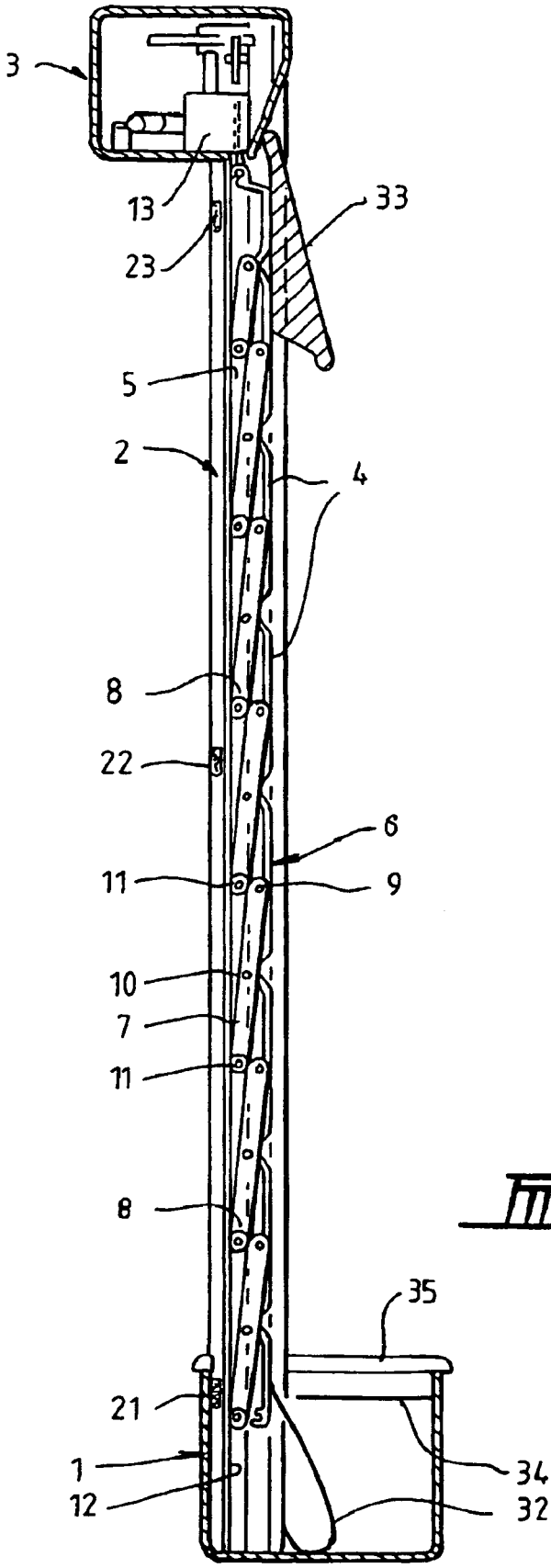
FIG. 4 shows a cut away side view with the shutter fully closed.

Referring now to FIGS. 2, 3 and 4 the operation of the slats can be seen where each of the mullions 2 are provided with vertical tracks 5 and a raising mechanism in the form of a pair of scissor or lazy tong type guides 6 which are positioned adjacent and to the inside of each mullion 2. The lazy tong guides are made up of a plurality of slave lever arms 7 which are interconnected by a plurality of pivots at the first ends thereof 8, second ends 9 and a central pivot 10 to receiving channels 18 provided at the end edges of the slats 4 in a progressive manner so as to make up a system of crossed levers which form the raising mechanism. In this manner the end edges of the slats 4 make up an active and integral part of the cross lever raising mechanism forming the lazy tong type guide. The raising mechanism is adapted to move from a concertinaed or closed position being fully retracted into the lower housing 1, as shown in FIG. 2, to an expanded position by being drawn up in a controlled manner along the track 5 of the side mullions 2. The lazy tong guides have associated therewith slats 4 and the movement of the raising mechanism from the first concertinaed position to the second expanded position, shown in FIG. 4, serves to lift up and configure the plurality of slats 4 from a first fully retracted position with all the slats lying on top of each other within the housing 1 to a fully expanded position with all the slats sitting in a substantially vertical plane, one after the other, as shown in FIG. 4. The raising mechanism of the invention provides a smooth and highly controllable means of raising the slats progressively up the height of the mullions such that in the fully expanded state the slats at the top are drawn into the upper head 3 so as to provide a continuous series of slats which serve to close off the opening of the frame and thereby serve to close off the shutter of the invention, preventing unwanted and unwelcome visual or physical traversal by the public.

The integration of the slats and the slave lever mechanisms ensure a highly efficient and, most importantly, highly secure and compact mechanism such that the interface formed by the slats when the shutter is closed are directly and integrally locked in the track system associated with the mullions thereby providing a high level of security for the closed shutter.

The slave levers 7 of the raising mechanism may be provided at a first end thereof 8 with captive guide rollers 11 which are adapted to fit within the track 5 which takes the form of a slot formed within the mullions 2. The rollers are thereby adapted to cooperate with this slot such that the guide will be drawn up and be unfolded in a direct vertical line corresponding with the verticality of the mullions. The captive guide rollers 11 are pivoted at a first end of the slave levers and then inserted into the end of the appropriate receiving channel 18 formed longitudinally along the slats 4 by way of a holding pin 19. The holding pin may be designed for a snug fit into the end of the receiving channel 18 such that the pin remains static relevant to the receiving channel and rotational movement is effected only via the slave levers and guide rollers. The slats are correspondingly drawn up and rotated between the mullions, as shown in FIG. 4 so as to close off the opening of the frame. The bottom of the track 5 may be provided with an elongate lower slot 12 which allows the fully expanded shutter to be drawn up out of the housing 1 so as to provide maximum coverage of the expanded shutter. The bottom slave lever may be provided with an elongate holding pin 19*a* which passes into a mulled slot of the mullion thereby preventing the slats from being lifted up and forced open from the lower end. The top slat may be provided with a top cover 33 which is adapted to sit over the opening 35 of the lower housing to protect the lower housing prior to activation of the shutter. The lower slat may be provided with a protective skirt 34 adapted to protect the open lower housing during activation and closing of the shutter.

Figure 6:
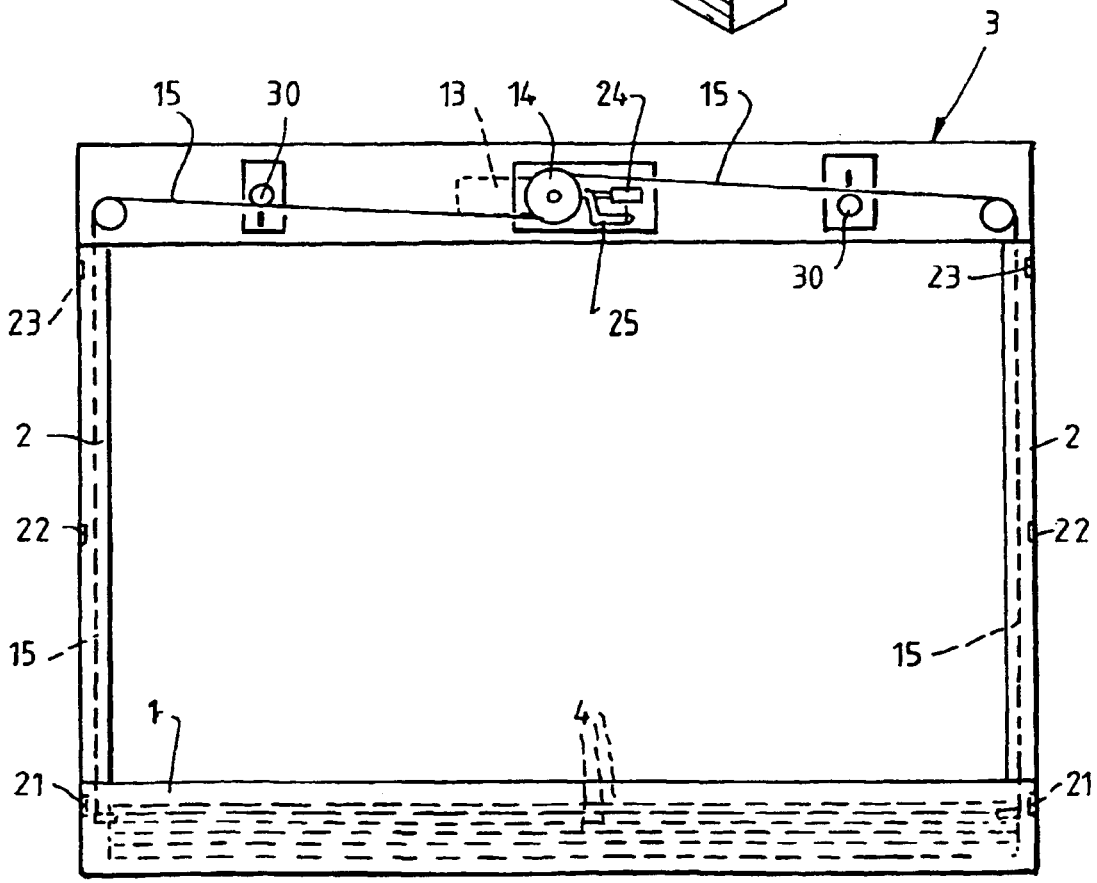
FIG. 6 shows detail of the operating mechanism.

Referring now to FIGS. 5, 6 and 7, the operation of the slats and the housing mechanism is effected by way of a motor 13 which may be positioned in the upper head 3 at a central position. The motor is provided with a draw-pulley 14 which serves to spool a pair of draw-wires 15 along the upper head and along each respective side mullion 2. The draw-pulley 14 takes the form of a spool having a spacer ratchet 15 and first flange 16 and second flange 17. The space allowed between the flanges and the spacer is sufficient to take up a single winding of the draw-wire 15 such that the spooling of the draw-wire causes the draw-wire to wind up upon the draw-pulley 14, thereby altering the torque to speed ratio for the given rotational speed of the draw-pulley 14. The draw-wire may be made up of a single wire passing through the pulley axle and emerging either side to form the separate wires which wind onto a common spool. Alternatively, the draw-wires can spool onto separate dedicated spools formed as a dual spool. The draw-wire may also be formed separately for winding onto a dual spool.

In this manner when the motor begins to draw up the slats the draw-wire is fully extended and begins to wind on to the pulley 14 with a small diameter of a spool. As the pulley keeps rotating the draw-wire builds up and increases the effective diameter of the spool thereby lowering the torque to speed ratio and effectively increasing the speed at which the slats are drawn up the security screen. In this manner, the operation of the shutter can be initiated with a high torque delivery to overcome the stationery inertia of the slats and provide acceleration as the slats draw up to the upper head thereby speeding up the closing of the shutter toward the ending of the operation.

The draw-pulley 14 is provided with a ratchet 26 which is most preferably formed integral with the spacer separating the spools. The ratchet is provided with a pawl 25 which is activated by a solenoid 24 such that it can be moved from an open to a closed position either locking the ratchet and draw-pulley 14 thereby preventing movement of the shutter in the downward direction or allowing free rotation of the draw-pulley. In this manner the activating mechanism is provided with a direct and highly secure action allowing rapid and precise control of the movement of the rising mechanism and the slats to ensure reliable and highly secure action for the shutter.

In addition the draw-wires can be provided with adjustment pulleys 30 to allow the slat level to be adjusted The speed of the slats as they are drawn close to the upper head of the shutter can be slowed by electronic control of the motor speed so as to ensure that the unit is not damaged or unnecessary violence is experienced in the operation of the shutter. The operation of the shutter can be monitored and controlled by a range of sensors including a first sensor 21 positioned at the lower end of the mullions which serves to monitor when the slats are in the fully retracted position. At this position the sensor causes the activation and locking of the draw-pulley 14 whereby the solenoid 24 is caused to activate the pawl 25 so as to engage the ratchet 26 of the draw-pulley. In this manner the slats and the shutter are locked in the retracted position and cannot be activated without proper authorisation or control. Moreover this sensor provides for the locking of the slats when they have returned from their expanded position to the withdrawn position so as to avoid any rebound which may occur as the slats fall down into the lower housing by the action of gravity. A second sensor 22 can be provided midway between the lower housing and the upper head and can be used to determine when slats are approaching the upper head and can cause the slowing down of the motor so as to avoid unnecessary impact of the slats as they approach the upper head and close off the shutter. An additional buffer can be provided in the form of a resilient band 32 positioned at the lower slat and adapted to "catch" the raising mechanism just as it approaches the top. A third sensor 23 can be positioned toward the upper head such that when the slats are fully expanded and the shutter fully closed the ratchet mechanism can again be activated and thereby ensuring that the shutter is completely locked and incapable of being opened without proper authorisation.

Figure 8:
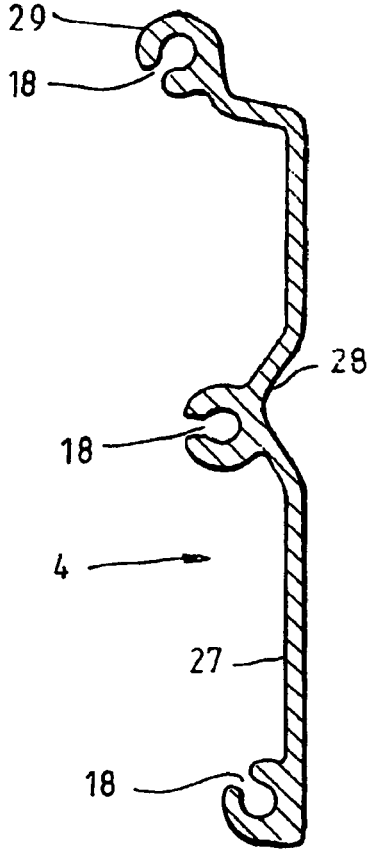
FIG. 8 shows a view of the elongate slats.

Referring now to FIG. 8, the shape and configuration of the slats is shown where the slats comprise an elongate substantially planar construction preferably formed out of a light weight and durable metal, for example aluminium or titanium. The slats comprise a planar face 27, an intermediate channel 28 and a stepped edge 29. The face surface of the slats is designed for positioning outward of the shutter and provides a highly resistant interface between the user and the public. The channel 28 provides a high level of reinforcement for the slats and the stepped edge 29 allows the consecutive slats to overlap. The rear side of these slats are provided with receiving channels 18 running the length of the slats which provide further reinforcement and in particular provide a locating means for the pivot points whereby the slats interconnect with the slave levers to form an integral part of the raising mechanism.

In use, the antibandit shutter of the invention can be readily retro-fitted to a wide variety of public interface situations with minimal interference to the available furnishings and design of such establishments. The shutter would be provided as a fully operational unit and retro-fitted to a counter where the housing 1 would provide a discreet presence on a counter-top that could be disguised with brochures, pamphlets, pot-plants etc. Once the shutter is installed it would, of course, normally be used in the retracted situation where the slats 4 are fully retracted into the housing 1 and all that is presented to the public is the closed frame presenting an open window or space through which communication and business can be conducted. When needed the operation of the unit can be effected by way of a simple switch which would be activated by user personnel activating the motor to draw the guide wires onto their respective spools to quickly draw up the slats 4 to close off the opening of the shutter. The slats are preferably formed of extruded aluminium with each slat forming one sector of the scissor type guide which controls the opening and closing and raising of the slats. As the raising mechanism is activated and drawn up the mullion, each slat moves in a controlled and rigidly supported manner as it is drawn up and orientated to form an opaque planer shutter.

The controlled operation of the shutter is ensured by the provision of two raising means positioned at either end of the slats and within the confines of the mullions 2. Draw-wires are attached to the top of the rising means using a shuttle 31 that is constrained within the guiding slot of the mullions and attached to the top slat with a rotating pin connection. Once the shutter is activated the draw-pulley ratchet is released and slats immediately commence rising up the mullion and accelerate with increased velocity as the slats approach the upper head. Once the shutter is closed, a sensor activates the draw-pulley ratchet and locks the shutter closed.

Once the shutter has been activated and the threat has been addressed the screen can be lowered back to its original retracted position by releasing the ratchet thereby allowing the slats to descend to the retracted position. The ratchet may be provided with safety switching such that the descent of the slats requires continuous pressure on a switch by an operator such that the inadvertent release of the switching will immediately arrest the descent and retraction of slats.

The invention provides for the first time an anti bandit shutter of intermediate rating and fundamentally different design to current systems which can be readily and economically retro-fitted to a wide range of public interface situations with minimal interference to the infrastructure involved. The degree of security provided by the shutter is one of primarily providing visual opacity; although the strength of the slatting material can be governed in accordance with the anticipated requirements. The shutter of the invention can provide a discrete interference system which can be readily operated to provide a very quick response to a threatening situation by the end user whereby the pressing of a button can immediately activate the motor and within a fraction of a second, cause the slats to be drawn up to the closed position thereby providing an opportunity for the user to evade a threat of physical violence by way of a knife, syringe or other form of attack and/or providing an opportunity to escape the attention of the perpetrator.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. An antibandit shutter comprising a closed frame made up of a lower housing, an upper head and two side mullions defining a space which can be opened or closed wherein said opening or closing is effected by a plurality of elongate slats adapted to move from a retracted position within the confines of said lower housing to an expanded and raised position substantially closing off said space, wherein each of said plurality of slats comprises three pivot points each including a receiving channel, and wherein said slats are guided along the mullions of said frame by a raising means comprising a plurality of crossed first and second lever arms removably attached to said plurality of slats at said receiving channels by respective holding pins in the form of a lazy tongs mechanism, wherein said first lever arms are formed by the edges of said slats and said second lever arms are formed from slave levers such that each of said plurality of slats functions as an arm link as well, and wherein said plurality of slats progressively accelerate in a controlled and continuous manner toward the raised closed position as they move up the housing.

2. An antibandit shutter according to claim 1 wherein said mullions are provided with tracks for guiding said raising means within the confines of said closed frame.

3. An antibandit shutter according to claim 1 wherein said raising means is adapted to move between a first concertinaed position within the confines of said lower housing and a second expanded position, drawing said slave levers and attached slats progressively up said mullions to said upper head of said shutter.

4. An antibandit shutter according to claim 3 wherein said slave levers are provided with rollers at a first end thereof adapted to cooperate with said track such that said rising means will be drawn up and expanded to unfold said slats in line with said mullions in a vertical orientation so as to close off said space in said frame.

5. An antibandit shutter according to claim 1, wherein said raising means is operated by motor drawn wires positioned in said mullions.

6. An antibandit shutter according to claim 5, wherein said raising means is actively moved from the retracted to the raised position by the action of a motor and passively returned to said retracted position by gravity.

7. An antibandit shutter according to claim 6, wherein said motor drawn wire cooperates with the motor by way of a draw-pulley which spools said draw-wire when the motor is activated.

8. An antibandit shutter according to claim 7, wherein said motor drawn wire is provided as a single wire passing through said pulley and winding onto a single spool.

9. An antibandit shutter according to claim 8, wherein said spool or spools are dimensioned to accommodate a single layer of draw-wire which winds onto itself during activation of the shutter such that the initial action of said motor provides a high start up torque and low speed spooling of the motor drawn wire which progresses to a low torque/high speed spooling as the shutter reaches the fully expanded position.

10. An antibandit shutter according to claim 7, wherein said draw-pulley has a dual spooling facility to simultaneously accommodate a pair of said draw wires operating in each track.

11. An antibandit shutter according to claim 7, wherein said draw-pulley has a locking ratchet associated therewith for arresting the rotation of said draw-pulley.

12. An antibandit shutter according to claim 11, wherein said ratchet is locked by a solenoid activated pawl.

13. An antibandit shutter according to claim 5, wherein said draw wires are provided with adjustment pulleys to allow the level of said slats to be adjusted to ensure alignment with said upper head.

14. An antibandit shutter according to claim 11 which incorporates sensors for determining the position of said slats.

15. An antibandit shutter according to claim 14, wherein a first sensor determines when said slats are fully retracted and causes the locking ratchet of said draw-pulley to lock thereby preventing rebound of the slats during gravity activated return to said lower housing.

16. An antibandit shutter according to claim 15, wherein a second sensor determines when said slats are approaching the expanded and raised position and causes said motor to slow down to cushion the impact of said slats on said upper head upon full expansion.

17. An antibandit shutter according to claim 16 further comprising a resilient stopper to cushion the impact of said slats on said upper head upon full expansion.

18. An antibandit shutter according to claim 16, wherein a third sensor determines when said slats are fully expanded and causes the locking ratchet of said draw-pulley to lock thereby preventing said slats from being forced open.

19. An antibandit shutter according to claim 1, wherein said slats are provided with a top cover and a protective skirt adapted to protect said lower housing prior to and during activation of said shutter.

* * * * *